US006099364A

United States Patent [19]

Shinchi

[11] Patent Number: 6,099,364

[45] Date of Patent: Aug. 8, 2000

[54] ULTRASONIC WELDING TERMINAL

[75] Inventor: Akira Shinchi, Shizuoka-ken, Japan

[73] Assignee: Yazaki Corporation, Tokyo, Japan

[21] Appl. No.: 09/003,365

[22] Filed: Jan. 6, 1998

[30] Foreign Application Priority Data

Jan. 9, 1997 [JP] Japan ..... 9-002321

[51] Int. Cl.[7] ..... H01R 4/02

[52] U.S. Cl. ..... 439/874; 439/877

[58] Field of Search ..... 439/874, 877, 439/879

[56] References Cited

U.S. PATENT DOCUMENTS

| | | | |
|---|---|---|---|
| 4,828,515 | 5/1989 | Senor et al. | 439/874 |
| 4,976,624 | 12/1990 | Ishizuka et al. . | |
| 5,413,506 | 5/1995 | Thompson . | |

FOREIGN PATENT DOCUMENTS

| | | |
|---|---|---|
| 0477759 A1 | 4/1992 | European Pat. Off. . |
| 7-70345 | 7/1995 | Japan . |
| 966887 | 5/1961 | United Kingdom . |
| 9800185 | 5/1998 | United Kingdom . |
| WO96/33523 | 10/1996 | WIPO . |

*Primary Examiner*—Paula Bradley
*Assistant Examiner*—Katrina Davis
*Attorney, Agent, or Firm*—Finnegan, Henderson, Farabow, Garrett & Dunner, L.L.P.

[57] ABSTRACT

An ultrasonic welding terminal which is suitable for ultrasonic welding of a covered wire is provided. The terminal is composed of a bottom plate in form of a sheet metal and an elastic contact piece connected with the bottom plate, for generating a force of repulsion. In an ultrasonic welding structure where, between a first resinous member and a second resinous member, the terminal is connected with the wire, even if the core lines are displaced by the shrinkage of the first and second members, the elastic contact piece can follow to such a displacement owing to the force of repulsion.

3 Claims, 4 Drawing Sheets

ULTRASONIC WELDING TERMINAL

BACKGROUND OF THE INVENTION

The present invention relates to a terminal for use in ultrasonic welding, which is electrically connected with a covered wire by ultrasonic energy. Note, in this specification, the terminal will be referred as "ultrasonic welding terminal", hereinafter.

Japanese Unexamined Patent Publication (Kokai) No. 7-70345 discloses a conventional ultrasonic welding terminal interposed between a first member and a second member, both of which are made of plastic materials to be molten by ultrasonic oscillation.

In the publication, the first member is provided with a plurality of grooves, while the second member is provided with a plurality of projections for respective engagement with the grooves. In order to connect the terminal to a covered wire having core lines covered with an insulation cover, the terminal is firstly accommodated in one of the grooves and the wire is laid on the terminal in succession. Note, the covered wire means that a wire has core lines covered with an insulating cover.

Then, the second member is laid on the first member so that the projections engage in the grooves, respectively. Next, under such a condition, the first and second members are vibrated by the ultrasonic waves while exerting a pressure on the members. Consequently, owing to this ultrasonic oscillation, the insulating cover is fused, so that the exposed core lines come into electrical contact with terminal. Simultaneously, the first member is also welded to the second member into one body, thereby completing an integrated connecting structure.

While, in the above-mentioned connecting structure, the electrical connection between the core line and the terminal is attained by the first and second members made of resinous (plastic) materials. Therefore, if the first and second members are subjected to forces to separate them from each other due to the resinous materials' shrinkage caused by a temperature change, the members' pressure on the core line and the terminal would be reduced to increase the contact resistance therebetween unfortunately.

SUMMARY OF THE INVENTION

It is therefore an object of the present invention to provide an ultrasonic welding terminal which is capable of preventing the contact resistance between the core lines and the terminal from increasing even though such a shrinkage due to the temperature change would occur to the resinous member pressing the core lines against the terminal.

The object of the present invention described above can be accomplished by an ultrasonic welding terminal for electrical connection with a covered wire having core lines covered with an insulating cover, the ultrasonic welding terminal comprising:

a bottom plate in form of a sheet metal; and an elastic contact piece arranged in a part of the ultrasonic welding terminal where the core lines are to be electrically connected;

wherein the elastic contact piece is connected with the bottom plate and formed so as to produce a force of repulsion to a direction away from the bottom plate.

In the above-mentioned ultrasonic welding terminal, preferably, the elastic contact piece is provided by folding back a part of the bottom plate so as to overlap with a remaining part of the bottom plate. Thus, owing to such a formation of the elastic contact piece, it is possible to manufacture the terminal of the invention from a sheet of plate.

It is more preferable that the above-mentioned ultrasonic welding further comprises a pair of side plates which are formed on opposing lateral edges of the bottom plate so as to stand perpendicular to the bottom plate and that the elastic contact piece is arranged between the pair of side plates.

In this case, it is expected that the side plates serve to protect the elastic contact piece in handling the terminal. Additionally, when connecting the covered wire with the terminal by the ultrasonic oscillation and even if the core lines of the covered wire move on the elastic contact piece together with the molten insulating cover, the conductivity between the core lines and the terminal would be ensured since the core lines come into contact with either one of the side plates.

In the present invention, it is also preferable that the elastic contact piece is formed so as to project apart from the bottom plate in form of a mountain and supported by the remaining part of the bottom plate at both of a base end terminating in the remaining part and a free end butting on the remaining part of the bottom plate. Then, since the elastic contact piece is supported by the bottom plate at both ends of the piece, the supporting form of the terminal against the core lines would be stabilized.

Alternatively, the elastic contact piece may be overhung by the remaining portion of the bottom plate through the base end terminating in the remaining part. In this case, the configuration of the terminal would be simplified to facilitate the production.

Providing that the elastic contact piece is overhung by the remaining portion of the bottom plate, it is more preferable that the ultrasonic welding terminal further comprises an elastic pusher plate which is arranged above the elastic contact piece in a manner that the covered wire is interposed between the elastic pusher plate and the elastic contact piece and which is provided by folding back another part of the bottom plate so as to overlap with the remaining part of the bottom plate. In this case, the core lines can be interposed between the elastic contact piece and the elastic pusher plate, thereby increasing a force for retaining the wire.

Furthermore, the elastic pusher plate may be provided with a dent portion which is capable of accommodating the elastic contact piece therein. Also in this case, owing to the engagement of dent portion with the elastic contact piece, it is possible to increase the force for retaining the wire, furthermore.

According to the present invention, there is also provided an ultrasonic welding terminal for electrical connection with a covered wire having core lines covered with an insulating cover, said ultrasonic welding terminal comprising:

a bottom plate in form of a sheet metal; and a pair of elastic contact pieces arranged above the bottom plate and deviated from each other in a longitudinal direction of the bottom plate;

wherein each of the elastic contact pieces is provided by folding back a part of the bottom plate so as to overlap with a remaining part of the bottom plate through a clearance.

In this case, owing to the provision of the plural elastic contact pieces, it is possible to stabilize the supporting form of the terminal against the core.

According to the present invention, there is also provided an ultrasonic welding structure comprising:

a first member;

a second member for engagement with the first member;

an ultrasonic welding terminal interposed between the first member and the second member, the ultrasonic welding terminal having an elastic contact piece for generates a force of repulsion; and a covered wire disposed between the second member and the ultrasonic welding terminal, the covered wire having core lines covered with an insulating cover;

wherein the ultrasonic welding terminal is electrically connected with the core lines of the covered wire, while the core lines are urged against the second member by the elastic contact piece.

In this structure, even if the core lines are displaced by the shrinkage of the first and second members, the elastic contact piece can follow to such a displacement owing to the force of repulsion. Accordingly, it is possible to usually ensure the stable contact load against the core lines, thereby to restrict an increasing of the contact resistance. Thus, it is possible to improve the electrical reliability in the electrical connecting part obtained by the ultrasonic oscillation.

These and other objects and features of the present invention will become more fully apparent from the following description and appended claims taken in conjunction with the accompany drawing.

BRIEF DESCRIPTION OF THE DRAWINGS

FIGS. 1A and 1B show a first embodiment of the present invention, in which FIG. 1A is a perspective view of an ultrasonic welding terminal and FIG. 1B is a cross sectional view of a wire connecting structure provided by ultrasonic oscillation using the ultrasonic welding terminal;

DESCRIPTION OF THE PREFERRED EMBODIMENT

Embodiments of the present invention will be described with reference to the drawings.

Figure 1A:
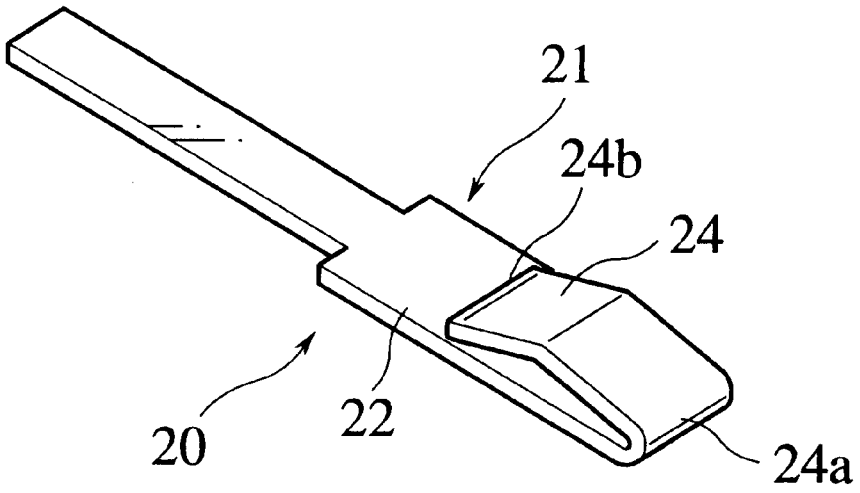
Figure 1B:
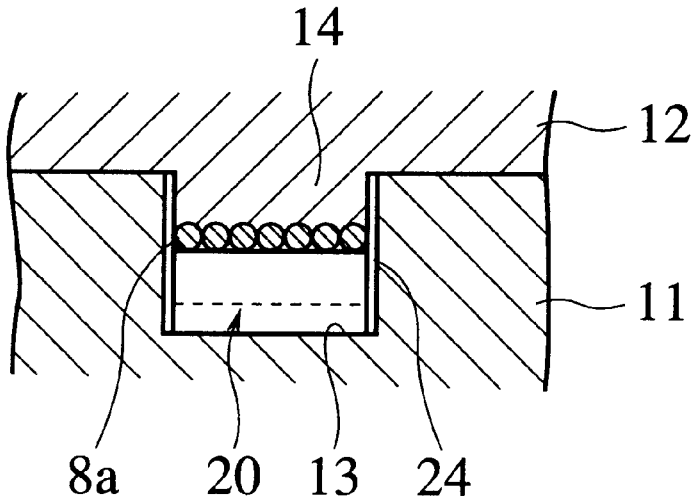

FIGS. 1A and 1B show the first embodiment of the present invention, in which FIG. 1A is a perspective view of an ultrasonic welding terminal and FIG. 1B is a cross sectional view of a wire connecting structure provided by ultrasonic oscillation using the ultrasonic welding terminal;

As shown in FIG. 1A, the ultrasonic welding terminal 20 of the first embodiment is made from a pressed and cut sheet metal and provided, on a rear end thereof, with a wire connecting part 21. The wire connecting part 21 includes an elastic contact piece 24 which projects upward like a mountain. This elastic contact piece 24 can be obtained by folding back a part of a bottom plate 22 so as to overlap with the remaining bottom plate 22. Accordingly, in a sense, the elastic contact piece 24 is supported by the bottom plate 22 through a base end 24*a* as the folding line and a free end 24*b* butting on the bottom plate 22. Owing to this supporting form and the above-mentioned configuration of the piece 24, when the elastic contact piece 24 is depressed, it then produces an upward force of repulsion.

Figure 2:
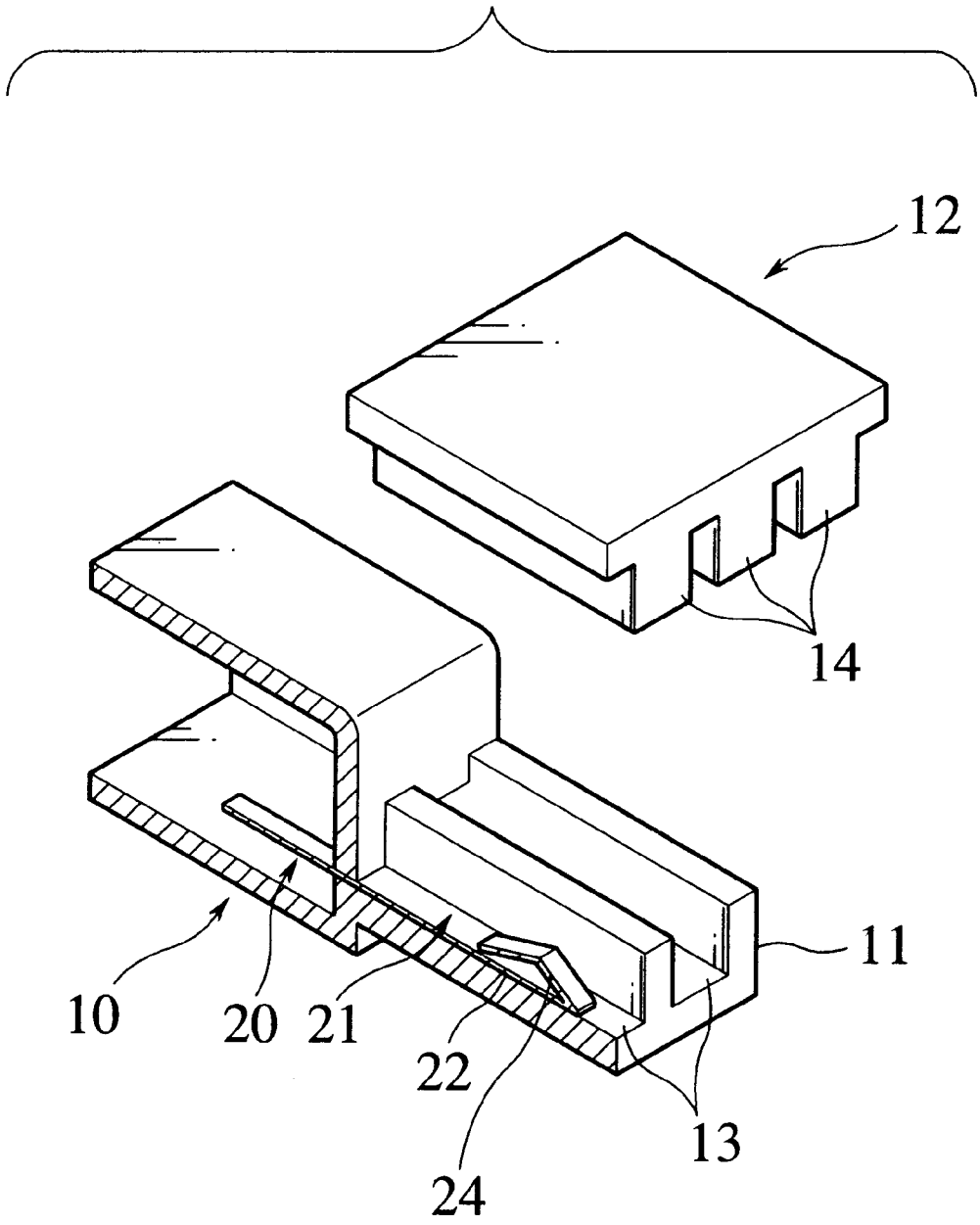
FIG. 2 is a perspective view showing a connector housing body (a first member) equipped with the ultrasonic welding terminal of the first embodiment and a cover body to be combined with the connector housing body.

FIG. 2 shows a connector housing body 10 (as a first member) equipped with the terminal 20, and a cover body 12 (as a second member). The connector housing body 10 is provided, at a rear end thereof, with a projecting terminal retainer 11 substantially corresponding to the above-mentioned first member. The terminal retainer 11 has a plurality of grooves 13 formed integrally therewith, while the cover body 12 has a plurality of projections 14 formed for respective engagement with the grooves 13. Both of the connector housing body 10 and the cover body 12 are formed of resinous materials which can be welded together by the ultrasonic welding.

In case of connecting the terminal 20 with a covered wire in order to provide a connector, the wire connecting part 21 of the terminal 20 is disposed in the groove 13 of the terminal retainer 11 and the covered wire is laid on an upper face of the elastic contact piece 24 in succession. Thereafter, the cover body 12 is put on the connector housing body 11, so that the projections 14 are inserted into the grooves 13 on the terminal retainer 11. Note, in this state, there are appropriate clearances left between the cover body 12 and the terminal retainer 11 (e.g. between the upper faces of the terminal retainer 11 and the lower faces of the cover body 12) for the purpose of concentrating the ultrasonic waves on a target point.

Under such a condition, the ultrasonic oscillation, i.e. vertical vibrations, is applied on the cover body 12 while pressing it by the ultrasonic horn. Consequently, the ultrasonic oscillation concentrates its ultrasonic energy on the projection 14 interposing the covered wire together with the groove 13, so that the insulating cover of the wire on the elastic contact piece 24 is fused to expose core lines 8*a*, as shown in FIG. 1B. Thus, since the fused cover is thrusted to the circumference, the core lines 8*a* are electrically connected with the terminal 20. It should be noted that, during the ultrasonic oscillation, the projection 14 of the cover body 12 serves to urge the core lines 8 against the terminal 20 in opposition to the repulsion of the elastic contact piece 24, thereby ensuring the contact load on the terminal 20. While, the cover body 12 is either welded to the connector housing body 10 or fixed thereto by another different means, whereby the connector is completed.

In the resultant structure, the elastic contact piece 24 supported by the base end 24*a* and the other end 24*b* usually urges the core lines 8*a* against the projection 14. Therefore, even if the cover body 12 and the connector housing body 10 shrink vertically due to a temperature change, it is possible to usually ensure the stable contact load against the cores 8*a* since the elastic contact piece 24 moves following to the shrinkage, thereby to restrict an increasing of the contact resistance. Thus, it is possible to improve the reliability of electrical connection.

Figure 3:
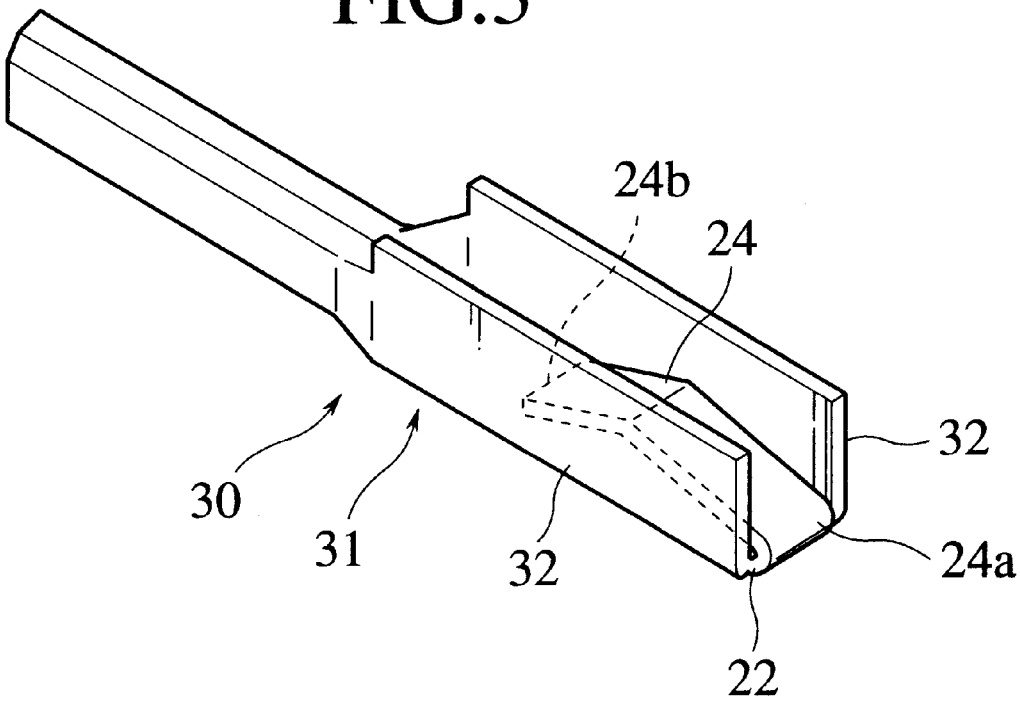
FIG. 3 is a perspective view of the ultrasonic welding terminal, in accordance with a second embodiment of the present invention.

FIG. 3 shows an ultrasonic welding terminal 30 in accordance with the second embodiment of the invention.

According to the second embodiment, an electrical connection part 31 of the terminal 20 is provided, on left and right edges of a bottom plate 22 thereof, with a pair of side plates 32*a* and 32*b* which stand perpendicular to the bottom plate 22 integrally and between which the elastic contact piece 24 is disposed. With this arrangement, it is possible to protect the elastic contact piece 24 from being damaged in handling the terminal solely. In addition, even if the core lines 8*a* (FIG. 1B) move on the elastic contact piece 24 together with the molten resin at the time of the ultrasonic oscillation, the conductivity between the core lines 8*a* and the terminal 30 can be ensured since the core lines 8*a* come into contact with either one of the side plates 32*a* and 32*b*.

Figure 4:
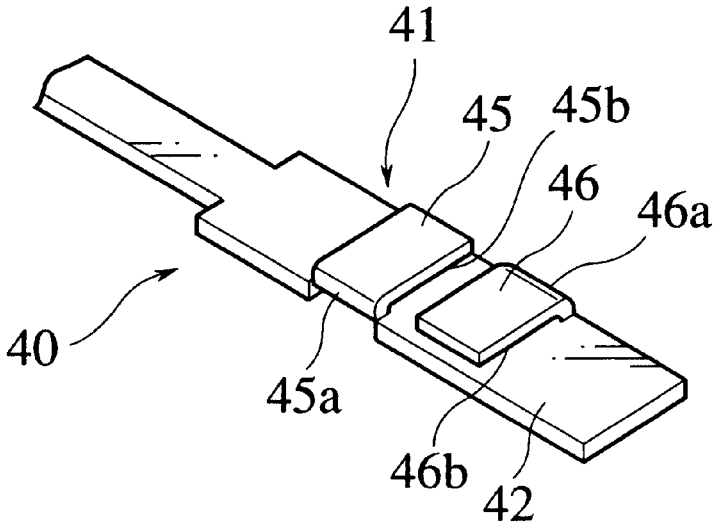
FIG. 4 is a perspective view of the ultrasonic welding terminal, in accordance with a third embodiment of the present invention.

FIG. 4 shows an ultrasonic welding terminal 40 in accordance with a third embodiment of the invention.

A wire connecting part 41 of a terminal 40 has a pair of pieces unshown, formed so as to project from left and right edges of a bottom plate 42. Further, the positions of the pieces are shifted from each other in the longitudinal direction of the plate 42. These pieces are folded back so as to overlap with the bottom plate 42, providing elastic contact pieces 45, 46. Therefore, the elastic contact pieces 45, 46 are overhung by the bottom plate 42 through their base ends 45*a* and 46*a*, in the form of a cantilever. For the flexibility of the pieces 45 and 46, clearances 45*b* and 46*b* are ensured between the pieces 45 and 46 and the bottom plate 42.

Also in this case, the terminal 40 can be connected with the covered wire by mounting the wire on the elastic contact pieces 45 and 46 and subsequently oscillating the terminal 40 with the ultrasonic waves. The operation of the pieces 45 and 46 when the temperature changes is similar to that of the previously mentioned piece 24. In addition, since the elastic contact pieces 45 and 46 are respectively formed so as to extend from the left and right side edges, the supporting stability for the core lines can be improved. Moreover, owing to the arrangement in the form of cantilever, the configuration of the terminal 40 is simplified to facilitate the worker's handling.

Figure 5:
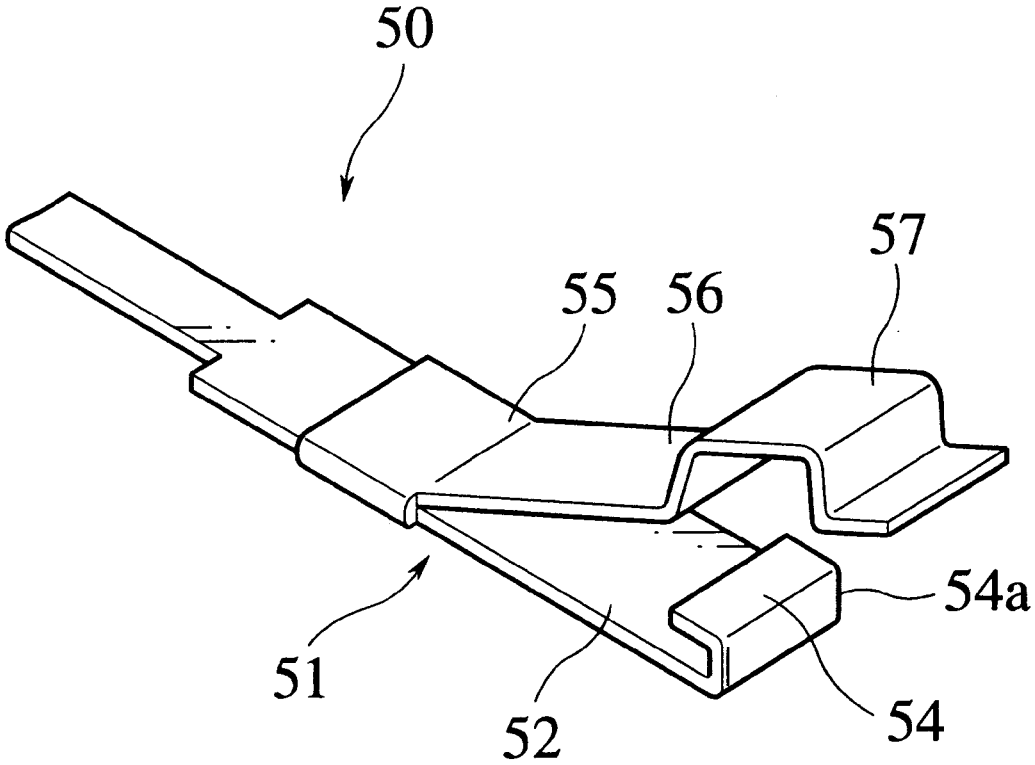
FIG. 5 is a perspective view of the ultrasonic welding terminal, in accordance with a fourth embodiment of the present invention.

FIG. 5 shows an ultrasonic welding terminal 50 in accordance with a fourth embodiment of the invention.

In a wire contact part 51 of the terminal 50, a small elastic contact piece 54 is provided by folding back a small extended piece formed on a rear end of a bottom plate 52, to the upside into a U-shaped configuration. Further, the wire contact part 51 is provided, above the elastic contact piece 54, with an elastic pusher plate 56 which can interpose the covered wire together with the piece 54. The elastic pusher plate 56 is formed so as to extend to rearward of a base piece 55 obliquely. Note, the base piece 55 is obtained by folding back an extended piece, which projects from the side edge of the bottom plate 52, so as to overlap with the plate 52. The elastic pusher plate 56 is provided, at a part thereof opposing to the elastic contact piece 54, with a dent portion 57 into which the piece 54 can be accommodated with a sufficient room. Owing to the provision of the dent portion 57, it is possible to interpose the core lines between the piece 56 and the piece 54 naturally.

In use, the covered wire (not shown) is inserted between the elastic contact piece 54 and the elastic pusher piece 56 from the backward and subsequently interposed therebetween while depressing the elastic pusher plate 56 by the projection of the cover body. Thereafter, the cover body is subjected to the ultrasonic oscillation. Consequently, the insulating cover is fused, so that the core lines therein can be connected with the terminal 50 finally.

Although the operation of the terminal 50 in a temperature changes is similar to those of the afore-mentioned terminals, it is possible to increase a force to retain the wire because of the arrangement where the core lines are held by the elastic contact piece 54 and the elastic pusher plate 56.

Finally, it will be understood by those skilled in the art that the foregoing descriptions relate to four embodiments of the disclosed ultrasonic welding terminal, and that various changes and modifications may be made to the present invention without departing from the spirit and scope thereof.

What is claimed is:

1. An ultrasonic welding terminal for electrical connection with a covered wire having core lines covered with an insulating cover, said ultrasonic welding terminal comprising:

a bottom plate having a first end and a second end in the form of a sheet metal;

an elastic contact piece arranged in a part of said ultrasonic welding terminal where said core lines are to be electrically connected, said elastic contact piece connected to said bottom plate and formed so as to produce an opposing force in response to an initial force exerted against the elastic contact piece, the opposing force exerted in a direction away from said bottom plate, said elastic contact piece formed by folding, at a folding point, the second end of the bottom plate upwards and towards the first end of the bottom plate so as to overlap with a remaining portion of said bottom plate between the first end of the bottom plate and the folding point, said bottom plate extending beyond said elastic contact piece in a direction away from the folding point; and an elastic pusher plate which is arranged above said elastic contact piece in a manner that said covered wire is interposed between said elastic pusher plate and said elastic contact piece, wherein said elastic pusher plate is formed by folding another part of said bottom plate so as to overlap with said remaining part of said bottom plate.

2. An ultrasonic welding terminal as claimed in claim 1, wherein said elastic pusher plate is provided with a dent portion which is capable of accommodating said elastic contact piece therein.

3. An ultrasonic welding terminal structure comprising:

a first member;

a second member for engagement with said first member;

an ultrasonic welding terminal interposed between said first member and said second member, said ultrasonic welding terminal having an elastic contact piece for generating an opposing force in response to an initial force exerted against the elastic contact piece; and a covered wire disposed between said second member and said ultrasonic welding terminal, said covered wire having core lines covered with an insulating cover;

wherein said ultrasonic welding terminal is electrically connected with said core lines of said covered wire by applying ultrasonic vibration to melt said insulating cover while said core lines are pressed against said second member by said elastic contact piece.

* * * * *